US009291965B2

(12) United States Patent
Naito et al.

(10) Patent No.: US 9,291,965 B2
(45) Date of Patent: Mar. 22, 2016

(54) FIXING DEVICE AND IMAGE FORMING APPARATUS HAVING A HEATING BELT AND A SUPPORTING MEMBER

(71) Applicant: FUJI XEROX CO., LTD., Tokyo (JP)

(72) Inventors: Yasutaka Naito, Kanagawa (JP); Eiichiro Tokuhiro, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/183,801

(22) Filed: Feb. 19, 2014

(65) Prior Publication Data

US 2015/0023703 A1 Jan. 22, 2015

(30) Foreign Application Priority Data

Jul. 19, 2013 (JP) ..... 2013-150572

(51) Int. Cl.
*G03G 15/20* (2006.01)

(52) U.S. Cl.
CPC .... *G03G 15/2053* (2013.01); *G03G 2215/2035* (2013.01)

(58) Field of Classification Search
CPC ..... G03G 15/2053; G03G 15/2064; G03G 2215/2016; G03G 2215/2025; G03G 2215/2029; G03G 2215/2032; G03G 2215/2035; G03G 2215/2038
USPC ..... 399/329; 219/216, 618
See application file for complete search history.

(56) References Cited

U.S. PATENT DOCUMENTS

| | | | | |
|---|---|---|---|---|
| 8,983,352 | B2 * | 3/2015 | Sasaki | 399/329 |
| 2014/0064786 | A1 * | 3/2014 | Mogi | 399/122 |

FOREIGN PATENT DOCUMENTS

| | | | |
|---|---|---|---|
| JP | A-2008-152247 | | 7/2008 |
| JP | 2010152053 | A * | 7/2010 |
| JP | A-2010-230820 | | 10/2010 |
| JP | 2013083941 | A * | 5/2013 |

* cited by examiner

*Primary Examiner* — Robert Beatty
(74) *Attorney, Agent, or Firm* — Oliff PLC

(57) ABSTRACT

A fixing device includes a magnetic field generator; a heating belt that heats toner on a transported sheet holding an unfixed toner image; a pressure roller that rotates while being pushed against an outer surface of the heating belt and that presses the sheet; a temperature-sensitive magnetic member that is disposed at an inner surface of the heating belt so as to oppose the magnetic field generator; a backing member that is disposed at the inner surface of the heating belt so as to oppose the pressure roller; and a supporting member that is disposed at an inner side of the heating belt, supports both end portions of the heating belt in a width direction, supports a back surface of the backing member, and supports the temperature-sensitive magnetic member.

5 Claims, 12 Drawing Sheets

FIXING DEVICE AND IMAGE FORMING APPARATUS HAVING A HEATING BELT AND A SUPPORTING MEMBER

CROSS-REFERENCE TO RELATED APPLICATIONS

This application is based on and claims priority under 35 USC 119 from Japanese Patent Application No. 2013-150572 filed Jul. 19, 2013.

BACKGROUND

Technical Field

The present invention relates to a fixing device and an image forming apparatus.

SUMMARY

According to an aspect of the invention, there is provided a fixing device including a magnetic field generator that generates a magnetic field; a heating belt that is heated by the magnetic field generated by the magnetic field generator, and that, while circulating, heats toner on a transported sheet holding an unfixed toner image; a pressure roller that rotates while being pushed against an outer surface of the heating belt and that presses the transported sheet as a result of interposing the sheet between the pressure roller and the heating belt; a temperature-sensitive magnetic member that is disposed at an inner surface of the heating belt so as to oppose the magnetic field generator with the heating belt being interposed between the temperature-sensitive magnetic member and the magnetic field generator, the temperature-sensitive magnetic member being heated by the magnetic field generated by the magnetic field generator; a backing member that is disposed at the inner surface of the heating belt so as to oppose the pressure roller with the heating belt being interposed between the backing member and the pressure roller, the backing member defining a movement path of a region of the heating belt that contacts the pressure roller; and a supporting member that is disposed at an inner side of the heating belt, supports both end portions of the heating belt in a width direction, supports a back surface of the backing member, and supports the temperature-sensitive magnetic member, the back surface of the backing member being a back surface in relation to a front surface of the backing member that contacts the inner surface of the heating belt. In the fixing device, the supporting member supports both end portions of the temperature-sensitive magnetic member in the width direction so as to avoid ununiform contact of the temperature-sensitive magnetic member with the heating belt caused by flexing of the supporting member due to the pressing by the pressure roller.

BRIEF DESCRIPTION OF THE DRAWINGS

Exemplary embodiments of the present invention will be described in detail based on the following figures, wherein.

DETAILED DESCRIPTION

Exemplary embodiments of the present invention are hereunder described.

Figure 1:
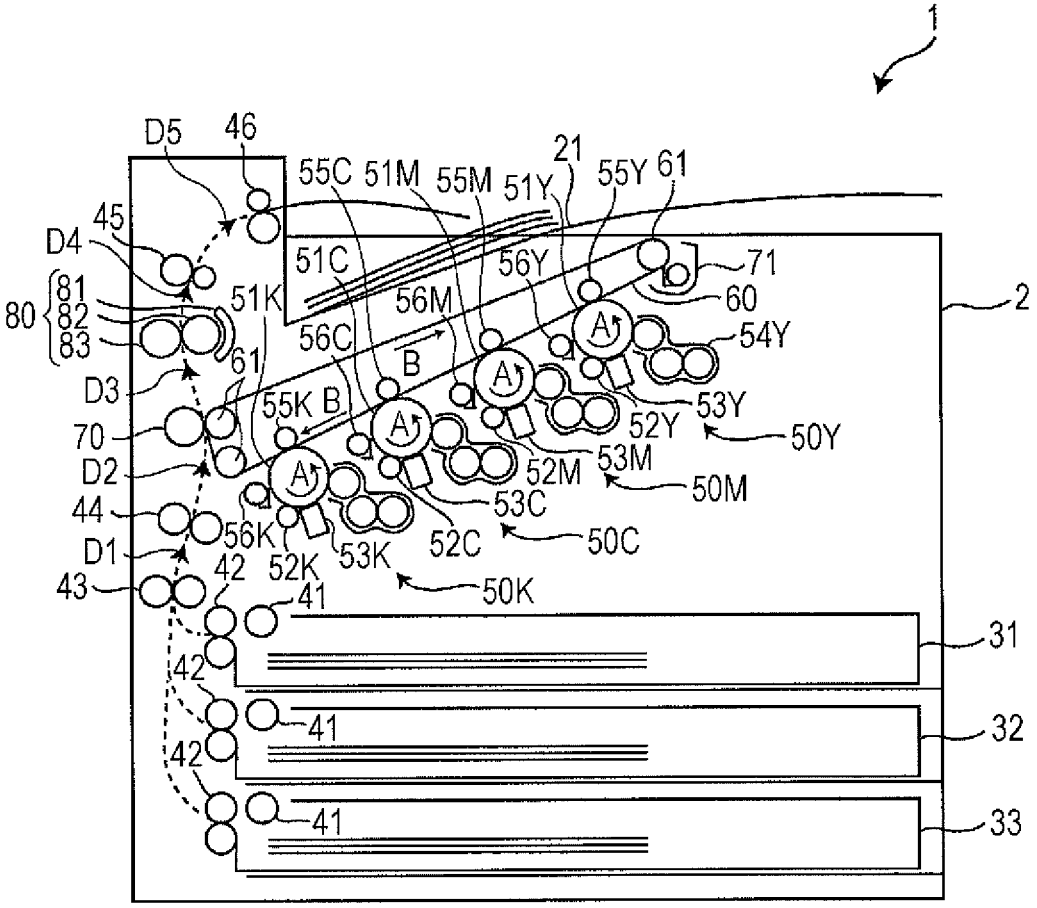
FIG. 1 is a schematic view of a structure of a printer serving as an image forming apparatus according to an exemplary embodiment of the present invention.

FIG. 1 is a schematic view of a structure of a printer 1 serving as an image forming apparatus according to an exemplary embodiment of the present invention. The printer 1 includes a fixing unit serving a fixing device according to an exemplary embodiment of the present invention.

The printer 1 includes three sheet trays, that is, sheet trays 31, 32, and 33, disposed at a lower portion of a housing 2. The sheet trays 31, 32, and 33 contain stacked unprinted sheets. These sheet trays 31, 32, and 33 are capable of being drawn from the housing 2 for replenishing the sheet trays 31, 32, and 33 with sheets. Each of the sheet trays 31, 32, and 33 is capable of containing sheets of a type (thin sheets, ordinary sheets, coated sheets, etc.) that differs from those of the other two sheet trays, or sheets having a size that differs from those of the other two sheet trays. The printer 1 includes pickup rollers 41 in correspondence with the sheet trays 31, 32, and 33. One sheet is taken out from the designated one of the sheet trays 31, 32, and 33 by the corresponding pickup roller 41. If multiple sheets are taken out in a superimposed state, corresponding separating rollers 42 reliably separate them from each other, and the separated sheets are transported one by one through a transport path (indicated by a broken line in FIG. 1) in the direction of D1 by transport rollers 43, and reach standby rollers 44. Transport of the sheet by rollers provided beyond the standby rollers 44 are described later.

The printer 1 includes four image formation engines, that is, image formation engines 50Y, 50M, 50C, and 50K. The image formation engines 50Y, 50M, 50C, and 50K are engines for forming a yellow (Y) toner image, a magenta (M) toner image, a cyan (C) toner image, and a black (K) toner image, respectively. In the description below, when the colors need not be distinguished, only reference numerals are used without the characters Y, M, C, and K that represent the colors.

Each image formation engine 50 includes a photoconductor member 51 that rotates in the direction of arrow A. An electrostatic latent image is formed on the surface of each photoconductor member 51 on the basis of electrostatic potential distribution. A charging unit 52, an exposing unit 53, a developing unit 54, a first transfer unit 55, and a cleaner 56 are provided around each photoconductor member 50. Here, each first transfer unit 55 is disposed at an inner side of an intermediate transfer belt 60, with the intermediate transfer belt 60 being interposed between the first transfer units 55 and the corresponding photoconductor members 50.

The intermediate transfer belt 60 is an endless belt that is wound upon rollers 61 and circulates in the direction of arrow B. A second transfer unit 70 and a cleaner 71 are disposed at corresponding ends of the intermediate transfer belt 60.

Each element that is provided around its corresponding photoconductor member 51 acts upon its corresponding photoconductor member 51 as follows.

Each charging unit 52 uniformly charges the surface of its corresponding photoconductor member 51.

Each exposing unit 53 emits exposure light modulated in accordance with image information that has been input from, for example, a computer (not shown), to form an electrostatic latent image on its corresponding photoconductor member 51.

Each developing unit 54 contains toner of a color that is in accordance with its corresponding image formation engine 50. Each developing unit 54 develops the electrostatic image on its corresponding photoconductor member 51 with the toner, to form a toner image on the surface of its corresponding photoconductor member 51.

Each transfer unit 55 transfers to the intermediate transfer belt 60 the toner image that is formed on its corresponding photoconductor member 51 so that the toner images are successively superimposed upon each other within the range in which the four image formation engines 50 are provided.

Each cleaner 56 cleans the surface of its corresponding photoconductor member 51 by collecting any toner remaining on its corresponding photoconductor member 51 after the transfer.

A sheet that has been transported up to the standby rollers 44 is transported out in the direction of D2 as a result of adjusting a timing in which the sheet is transported so that the sheet reaches the second transfer unit 70 at a timing in which the toner images transferred to the intermediate transfer belt 60 reach the position of the second transfer unit 70. The toner images on the intermediate transfer belt 60 are transferred to the transported sheet by the action of the second transfer unit 70.

A surface of the intermediate transfer belt 60 after the transfer is cleaned by the cleaner 71.

The sheet to which the toner images have been transferred by the action of the second transfer unit 70 is transported in the direction of arrow B3 and reaches a fixing unit 80 while the sheet holds the unfixed toner images. The fixing unit 80 corresponds to an example of what is called a fixing device in the present invention, and to an example of what is called a fixing section of an image forming apparatus in the present invention.

The fixing unit 80 includes an induction heater 81, a heating belt 82, and a pressure roller 83. The sheet passes a location between the heating belt 82 and the pressure roller 83. During the passage of the sheet, the toner images on the sheet are heated and pressed and fixed to the sheet. The induction heater 81 subjects the heating belt 82 to induction heating. The sheet that has been subjected to fixing by the fixing unit 80 is further transported in the direction of arrow D4, and then in the direction of arrow D5 by transport rollers 45. Discharge rollers 46 cause the sheet to be discharged onto a sheet-output tray 21 provided at an upper surface of the housing 2.

Figure 2:
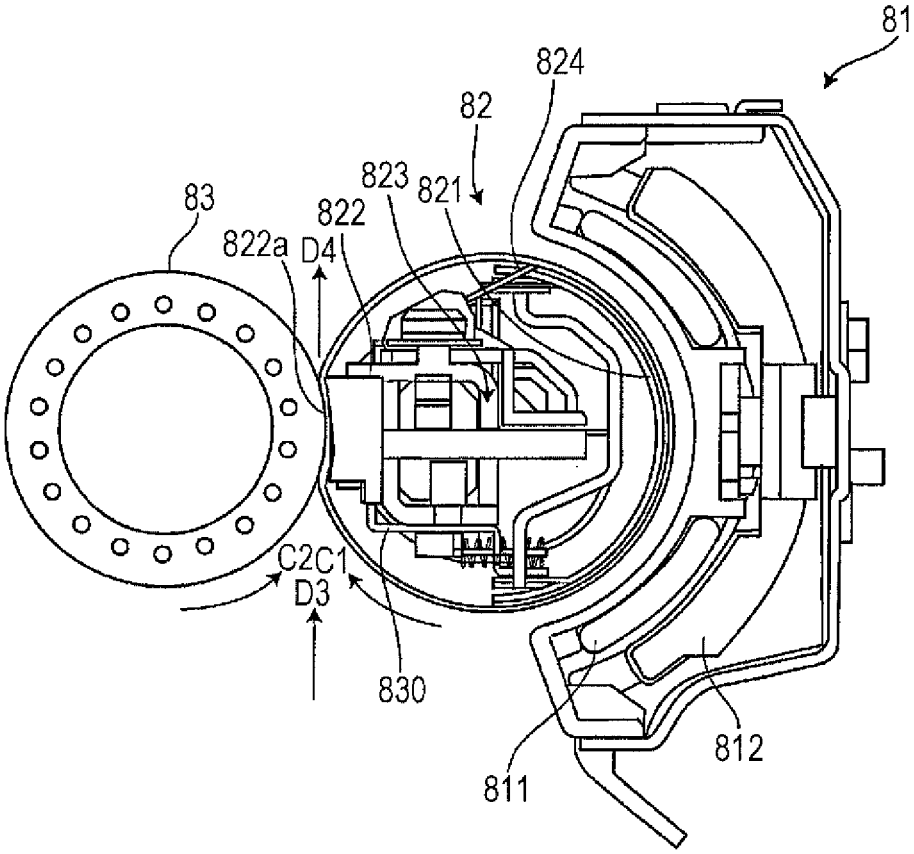
FIG. 2 is a sectional view of a structure of a fixing unit shown in FIG. 1.

FIG. 2 is a sectional view of a structure of the fixing unit shown in FIG. 1.

As described above, the fixing unit 80 includes the induction heater 81, the heating belt 82, and the pressure roller 83. Here, the induction heater 81, the heating belt 82, and the pressure roller 83 correspond to examples of what are called a magnetic field generator, a heating belt, and a pressure roller, respectively.

A temperature-sensitive magnetic member 821 that is provided adjacent to the inductive heater 81 is provided at an inner side of the heating belt 82. In the exemplary embodiment, the temperature-sensitive magnetic member 821 is disposed apart from an inner surface of the heating belt 82. A shielding member 829 formed of aluminum and intercepting magnetic force that has leaked out from the temperature-sensitive magnetic member 821 is disposed at an inner side of the temperature-sensitive magnetic member 821. Further, a backing member 822 is provided at the inner side of the heating belt 82 and adjacent to the pressure roller 83.

A supporting member 823 that supports the temperature-sensitive magnetic member 821, the shielding member 829, and the backing member 822 is shown at a location between the shielding member 829 and the backing member 822. The supporting member 823 is, along with a backing member holder 830 and belt supporting members 825 and 826 (described later; see FIG. 3), a member that constitutes an example of what is called a supporting member according to the present invention. A supporting structure including the supporting member 823 is described later. Further, a temperature sensor 824 that contacts the inner surface of the heating belt 82 and measures the temperature of the heating belt 82 is also shown here. The heating belt 82 itself also includes a magnetic layer and has a structure that allows it to be directly subjected to induction heating.

The induction heater 81 includes an induction heating coil 811 and a magnetic member 812 disposed behind the induction heating coil 811. When electric current flows through the coil 811, a magnetic field is generated, so that the heating belt 82 and the temperature-sensitive magnetic member 821 at the inner side of the heating belt 82 are heated. The heating belt 82 rotates in the direction of arrow C1, and heats toner on a sheet which holds unfixed toner images and which is transported in the direction of arrow D3.

The backing member 822 is disposed at the inner surface of the heating belt 82 so as to oppose the pressure roller 83 with the heating belt 82 being disposed between the backing member 822 and the pressure roller 83. A backing surface 822*a* of the backing member 822 faces and contacts the inner surface of the heating belt 82. A region of the heating belt 82 that contacts the backing surface 822*a* is interposed between the backing member 822 and the pressure roller 83, and moves along a movement path in accordance with the shape of the backing surface 822*a*.

The pressure roller 83 is pushed against an outer surface of the heating belt 82, rotates in the direction of arrow C2, and presses a sheet that has been transported in the direction of D3 as a result of interposing the sheet between the pressure roller 83 and the heating belt 82. The surface of the pressure roller 83 is formed of an elastic material that deforms in accordance with the shape of the backing surface 822*a* of the backing member 822 when the surface of the pressure roller 83 is pushed against the heating belt 82.

Figure 3:
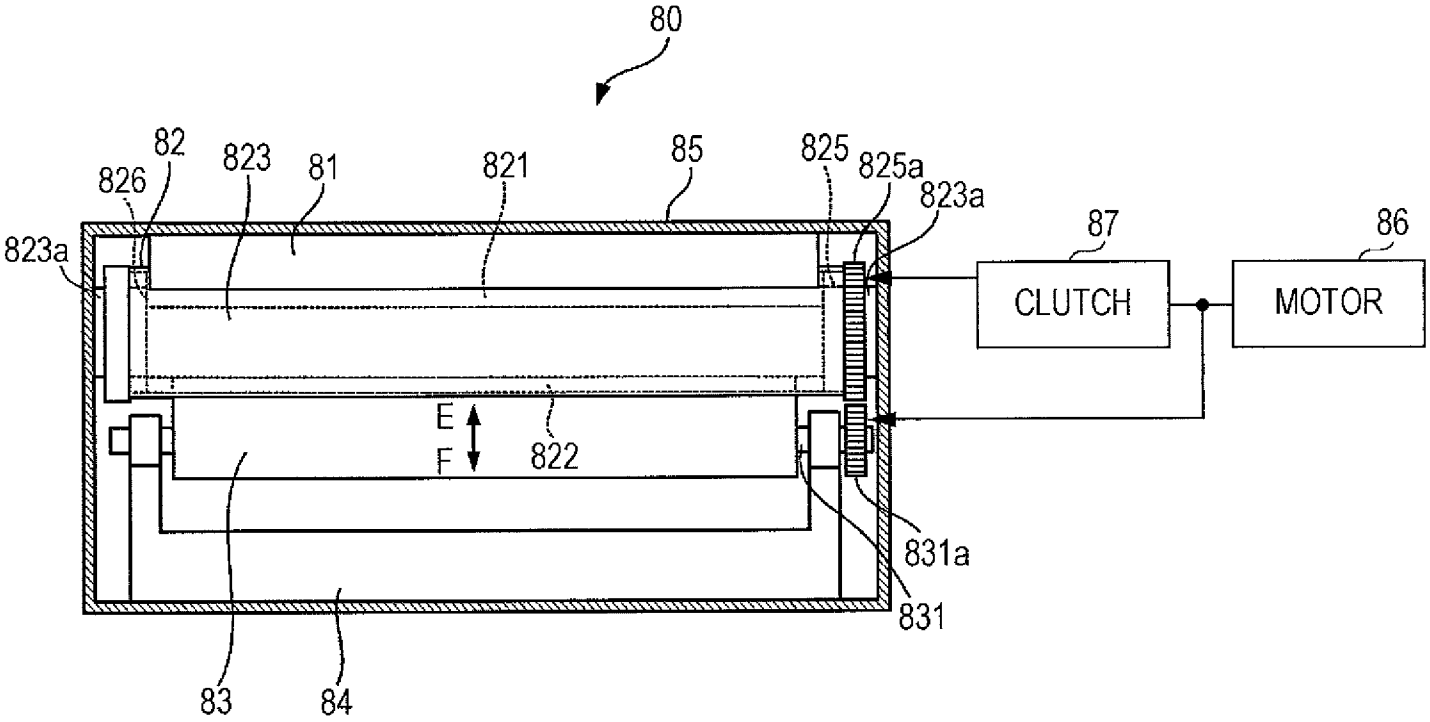
FIG. 3 is an explanatory view of a supporting structure and a driving system of a heating belt and a pressure roller.

FIG. 3 is an explanatory view of the supporting structure and a driving system of the heating belt and the pressure roller.

Here, a sectional view taken along the direction of a line passing through a center of rotation of the heating belt 82 is shown.

Circular belt supporting members 825 and 826 are fitted to corresponding width-direction ends of the heating belt 82. This causes both ends of the heating belt 82 to be held in a cylindrical structure. Of the belt supporting members 825 and 826, the belt supporting member 825 is provided with a gear 825*a* for receiving rotation driving force that has been transmitted from a motor 86. The belt supporting member 825 is fitted to one end of the heating belt 82, and bonded to the inner surface of the heating belt 82. The belt supporting member 825 is rotatably supported by the supporting member 823 provided at the inner side of the heating belt 82. The belt supporting member 826 is formed so that the portion fitted to the heating belt 82 and the inner surface of the heating belt 82 slide. The belt supporting member 826 is unrotatably secured to the supporting member 823. Both width-direction end portions 823*a* of the supporting member 823 are secured to a housing 85 of the fixing unit 80, so that an overall doubly supported beam structure is formed.

Both ends of the pressure roller 83 are rotatably supported by a moving mechanism 84. The moving mechanism 84 is secured to the housing 85 of the fixing unit 80. The moving mechanism 84 moves the pressure roller 83 in directions in which the pressure roller 83 contacts and separates from the heating belt 82 (that is, in the directions of a double-headed arrow E-F), and pushes the pressure roller 83 against the heating belt 83 and separates the pressure roller 83 from the heating belt 82, respectively. A gear 831*a* is secured to a rotary shaft 831 at the pressure roller 83. Rotation driving force from the motor 86 is also transmitted to the gear 831*a*.

The rotation driving force from the motor 86 is transmitted to the gear 825*a* of the belt supporting member 825 that is bonded and secured to the heating belt 82 via a driving force transmission mechanism, such as a gear train (not shown), and via a one-way clutch 87. Although, the rotation driving force from the motor 86 is also transmitted to the gear 831*a* that is secured to the rotary shaft 831 of the pressure roller 83, the rotation driving force from the motor 86 is transmitted without being transmitted via the one-way clutch 87.

Here, a gear ratio or the like is adjusted so that the surface speed of the pressure roller 83 is slightly higher than the circulation movement speed of the heating belt 82. Therefore, when the pressure roller 83 rotates while in contact with the heating belt 82, the one-way clutch 87 operates and cuts off the transmission of the rotation driving force from the motor 86 towards the gear 825*a* at the heating belt 82, so that the heating belt 82 is driven and rotated by the rotation of the pressure roller 83. In contrast, when the pressure roller 83 is separated from the heating belt 82, the heating belt 82 is rotated by the rotation driving force that has been transmitted via the one-way clutch 87.

Figure 4:
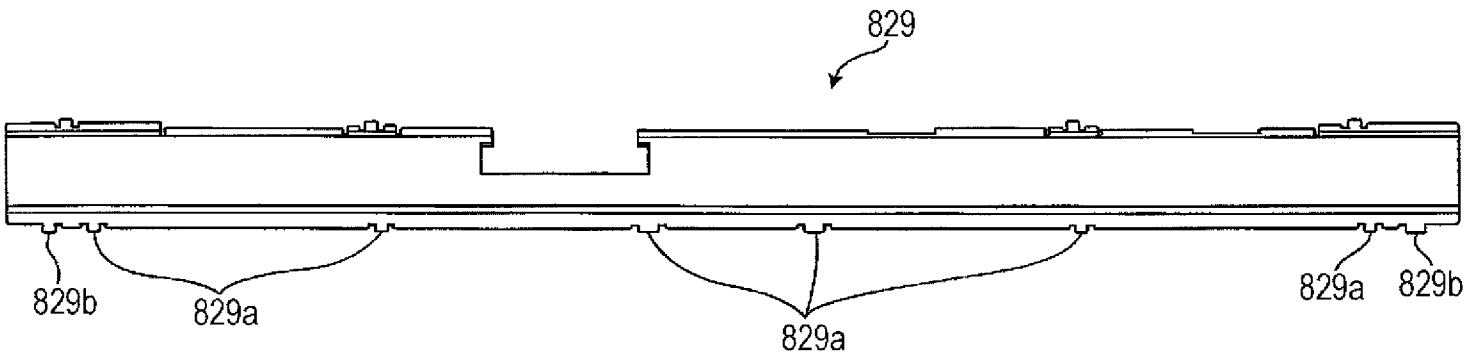
FIG. 4 is a plan view of a shielding member schematically shown in cross section in FIG. 2.

FIG. 4 is a plan view of the shielding member 829 schematically shown in cross section in FIG. 2. Here, FIG. 4 shows a state in which the fixing unit 80 shown in FIG. 1 is rotated by 90 degrees and the IH heater 81 is at an upper side. That is, the plan view thereof shows the shape of the shielding member 829 when the shielding member 829 is viewed from the side of the IH heater 81. The figures described below also indicate the orientation of the shielding member 829 when the IH heater 81 is at the upper side.

Figure 5:
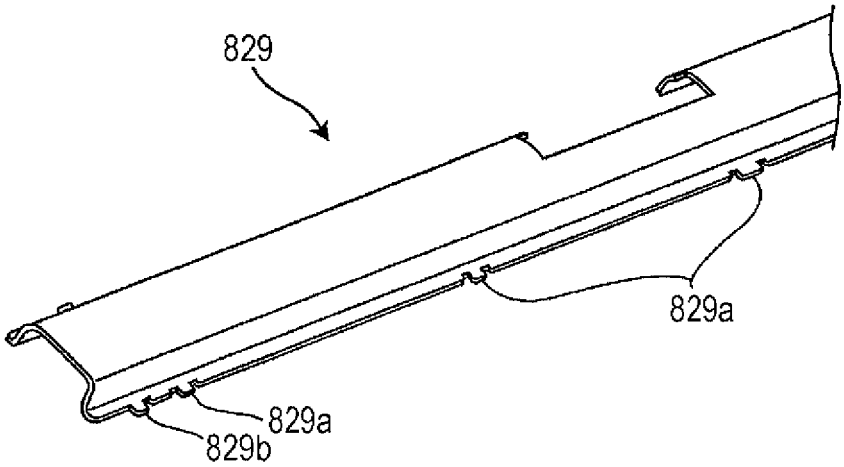
FIG. 5 is a perspective view of part of the shielding member.

FIG. 5 is a perspective view of part of the shielding member 829.

The shielding member 829 is formed of aluminum and has a substantially C shape in cross section. As described above, the shielding member 829 is provided at the inner side of the heating belt 82 and inwardly from the temperature-sensitive magnetic member 821, and intercepts magnetic force that has leaked out from the temperature-sensitive magnetic member 821.

Six lugs 829*a* that engage with holes in the temperature-sensitive magnetic member 821 (see FIG. 1; the details are given later) are formed in the shielding member 829 in a longitudinal direction. Lugs 829*b* that engage with holes in the backing member holder 830 (see FIG. 1; the details are given later) that supports the backing member 822 (see FIG. 1) are formed in the vicinity at both ends.

Figure 6:
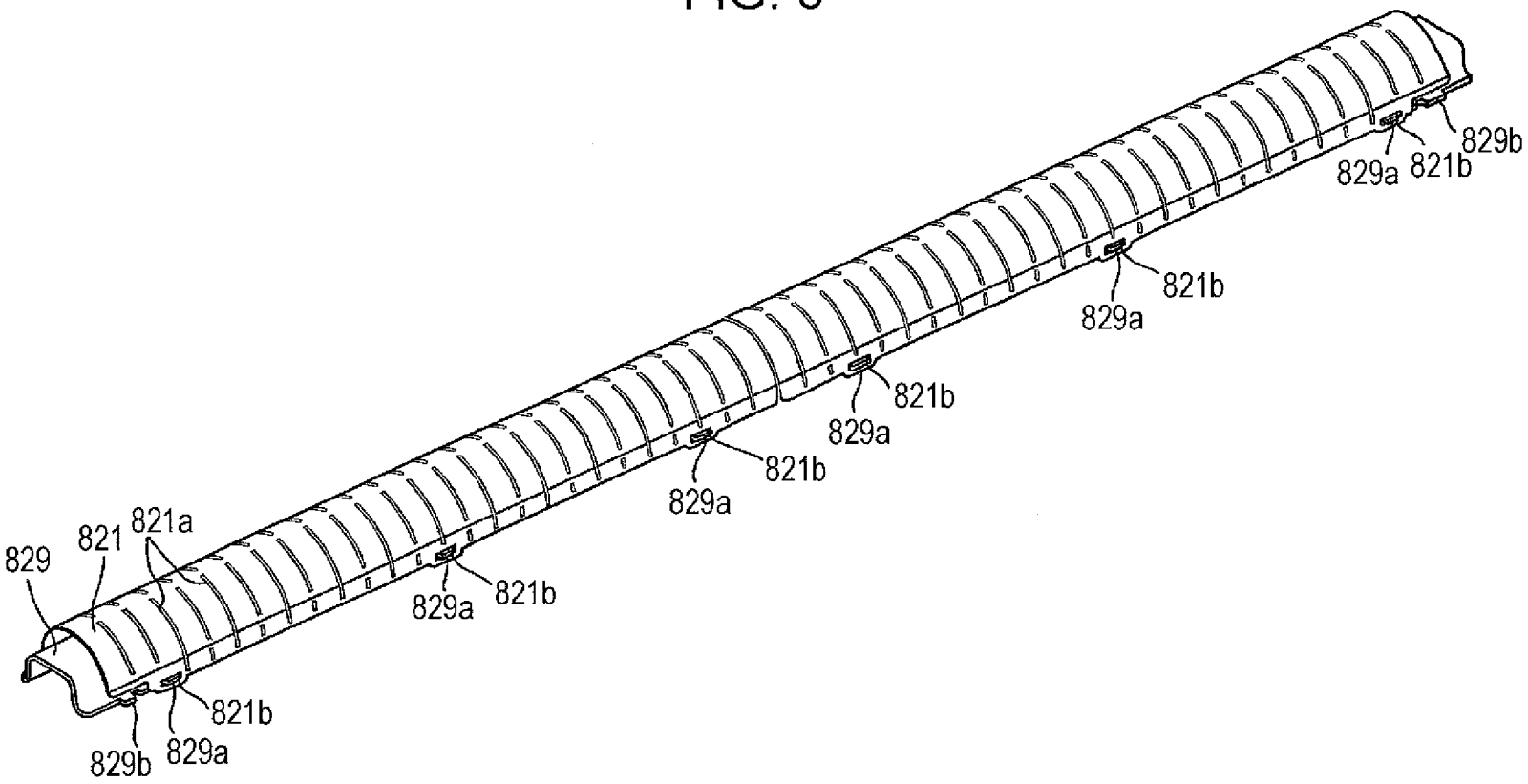
FIG. 6 is a perspective view showing a state in which a temperature-sensitive magnetic member is mounted on the shielding member.

FIG. 6 is a perspective view of a state in which the temperature-sensitive magnetic member 821 is mounted on the shielding member 829.

Figure 7:
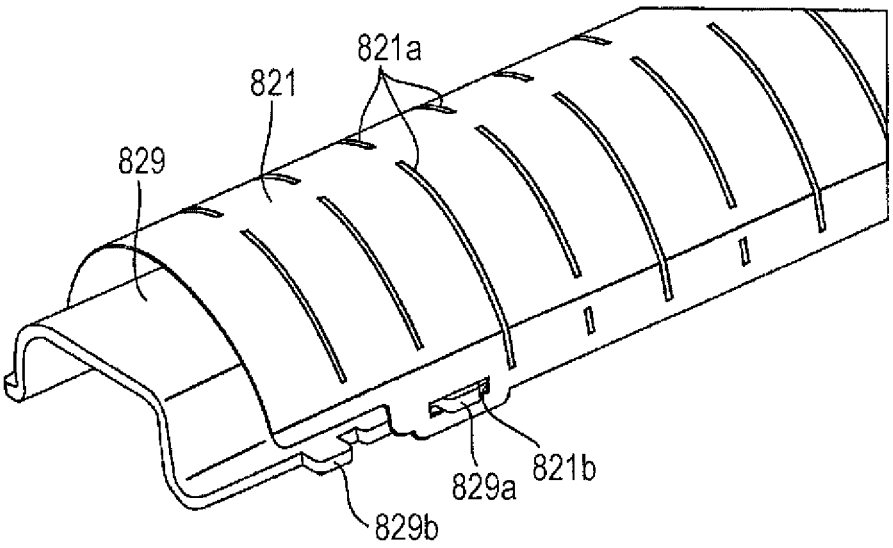
FIG. 7 is an enlarged perspective view of an end portion of a structural member shown in FIG. 6 in which the temperature-sensitive magnetic member is mounted on the shielding member.

FIG. 7 is an enlarged perspective view of an end portion of a structural member shown in FIG. 6 in which the temperature-sensitive magnetic member 821 is mounted on the shielding member 829.

Figure 8:
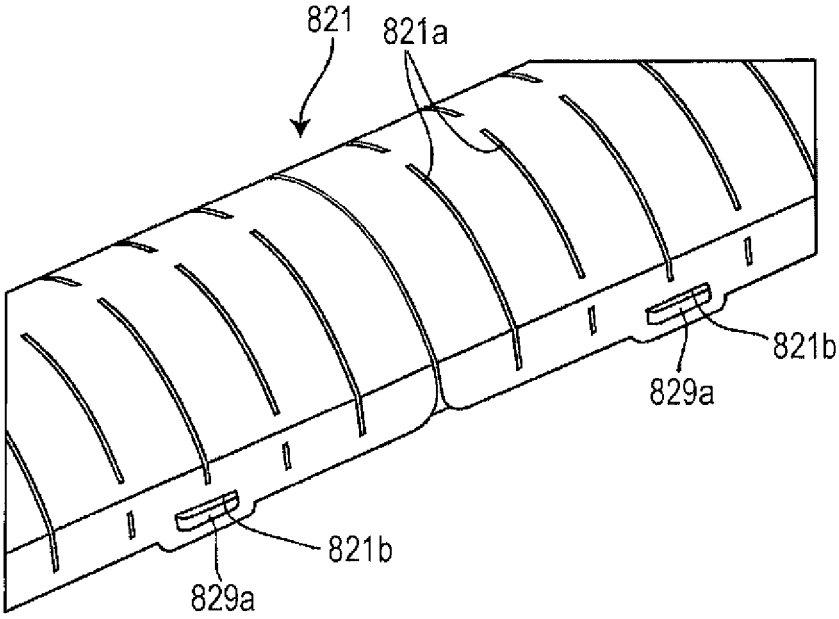
FIG. 8 is an enlarged perspective view of a central portion of the structural member shown in FIG. 6 in which the temperature-sensitive magnetic member is mounted on the shielding member.

FIG. 8 is an enlarged perspective view of a central portion of the structural member shown in FIG. 6 in which the temperature-sensitive magnetic member 821 is mounted on the shielding member 829.

The temperature-sensitive magnetic member 821 includes two plate members that are arc-shaped and are divided from each other at the longitudinal-direction center of the temperature-sensitive magnetic member 821. Slits 821*a* are formed in the temperature-sensitive magnetic member 821. Holes 821*b* that receive the six lugs 829*a* are formed in the temperature-sensitive magnetic member 821 in correspondence with the six lugs 829*a* that are provided at the shielding member 829. The temperature-sensitive magnetic member 821 is held by the shielding member 829 when the lugs 829*a* of the shielding member 829 enter the holes 821*b*.

Figure 9:
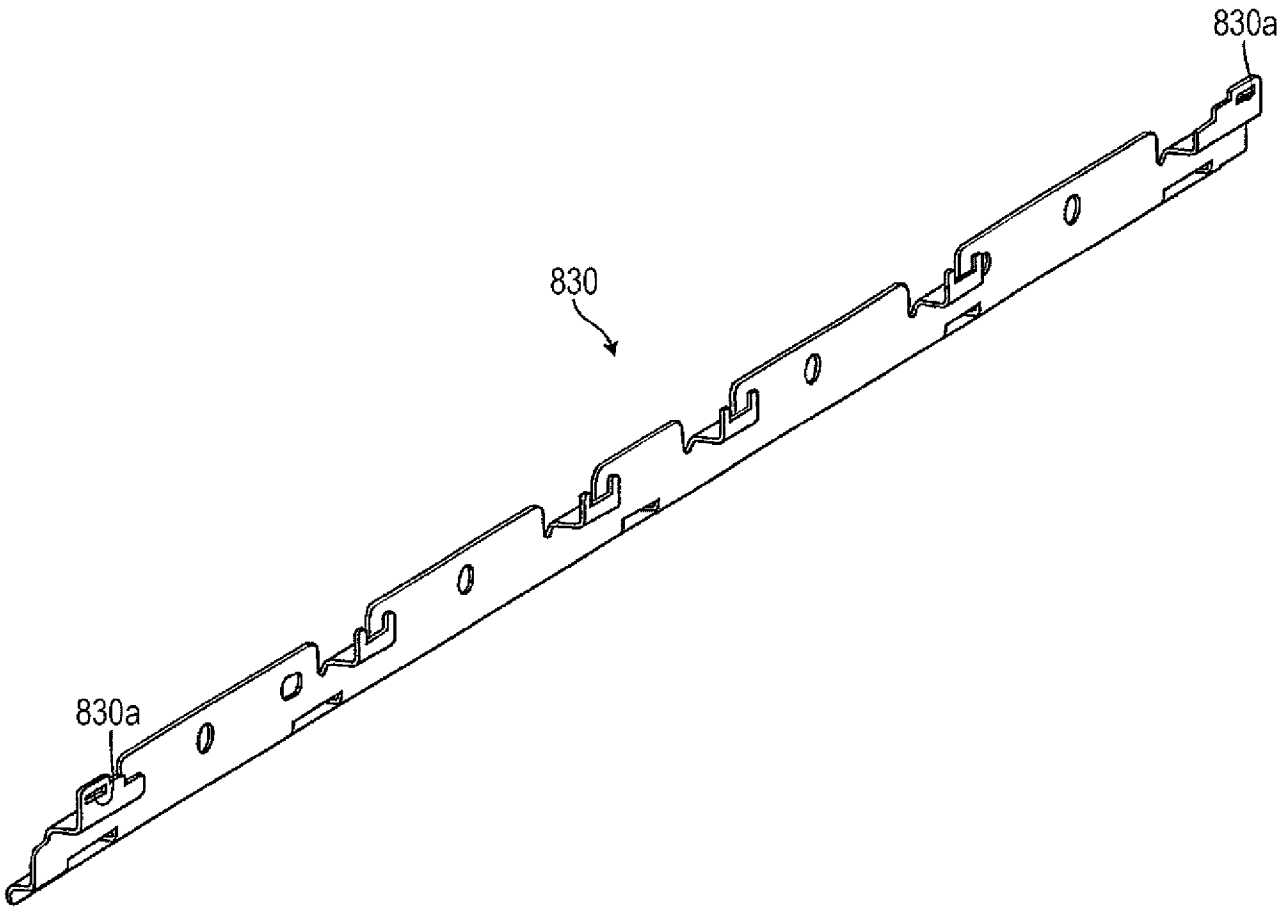
FIG. 9 is a perspective view of a backing member holder.

FIG. 9 is a perspective view of the backing member holder 830.

The backing member holder 830 (also see FIG. 1) is a member that supports the backing member 822 that contacts the inner surface of the heating belt 82. The backing member 822 is supported by the backing member holder 830 with the back surface of the backing member 822 being in contact with the supporting member 823.

Two holes 830*a* are formed, each in an end portion of the backing member holder 830. The holes 830*a* allow the shielding member 829 to be supported when the lugs 829*b* of the shielding member 829 (see FIG. 1 and FIGS. 4 to 7) enter the holes 830*a*.

Figure 10:
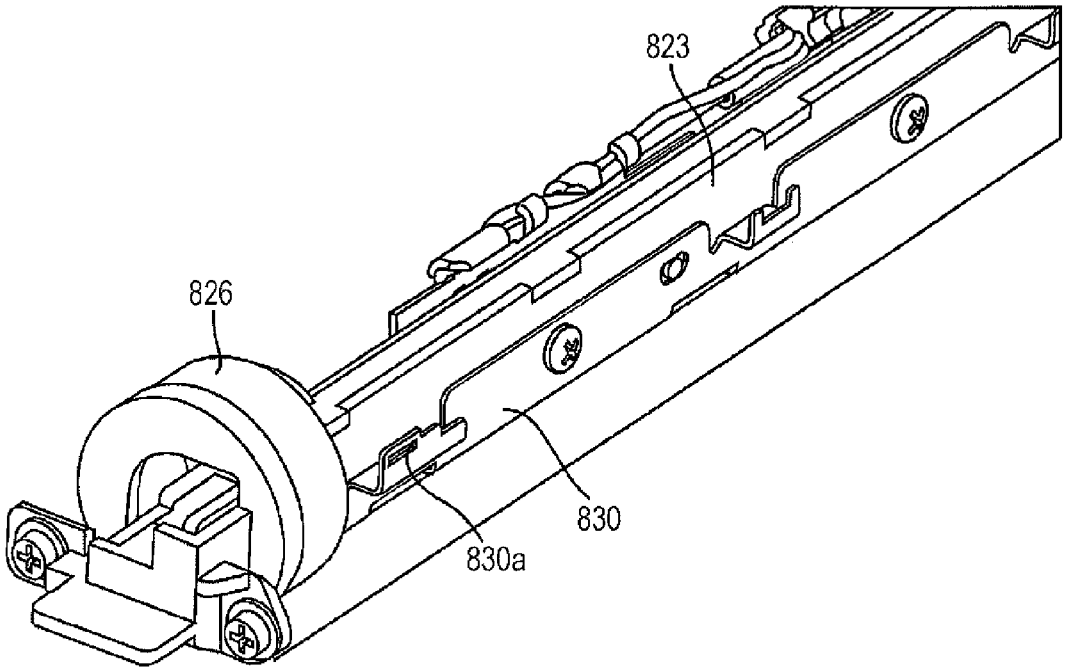
FIG. 10 is a perspective view showing a state in which the backing member holder is mounted on a supporting member.

FIG. 10 is a perspective view of a state in which the backing member holder 830 is mounted on the supporting member 823.

FIG. 10 does not show the heating belt 82 (see FIG. 1). FIG. 10 shows the belt supporting member 826 (also see FIG. 3) that supports one end portion of the heating belt 82 in a cylindrical structure. As shown in FIG. 10, the backing member holder 830 is secured by being screwed to the supporting member 823. As described above, the belt supporting member 826 and the backing member holder 830 are, along with the supporting member 823, examples of what is called a supporting member.

Figure 11:
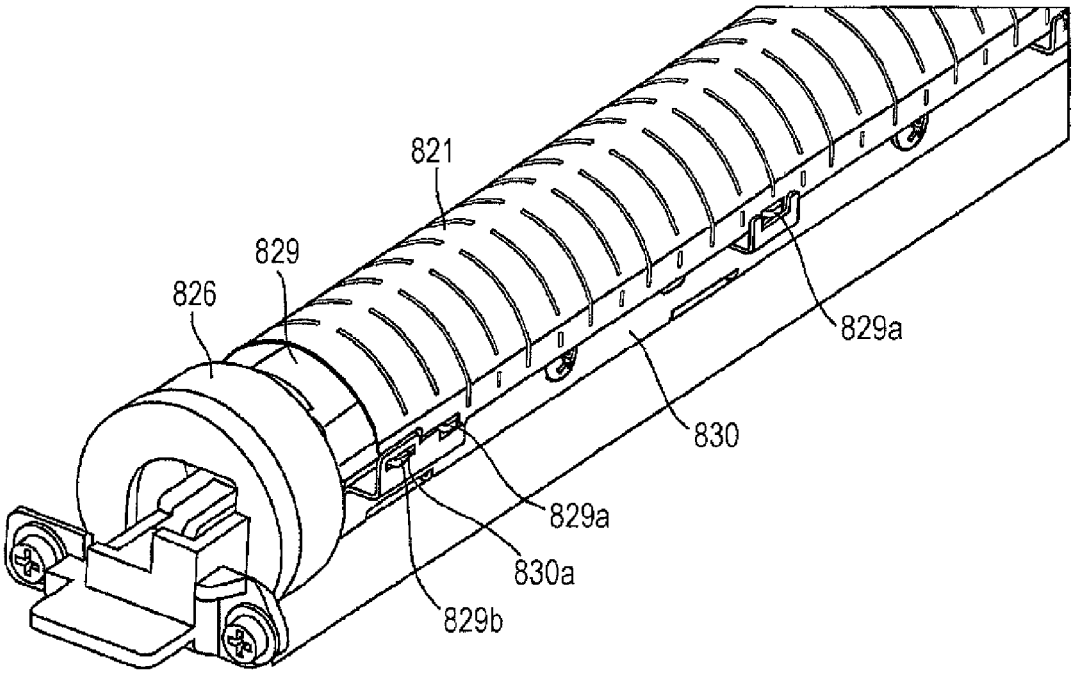
FIG. 11 is a partial perspective view showing a state in which the shielding member is supported by the backing member holder.

FIG. 11 is a partial perspective view of a state in which the shielding member 829 is supported by the backing member holder 830.

Figure 12:
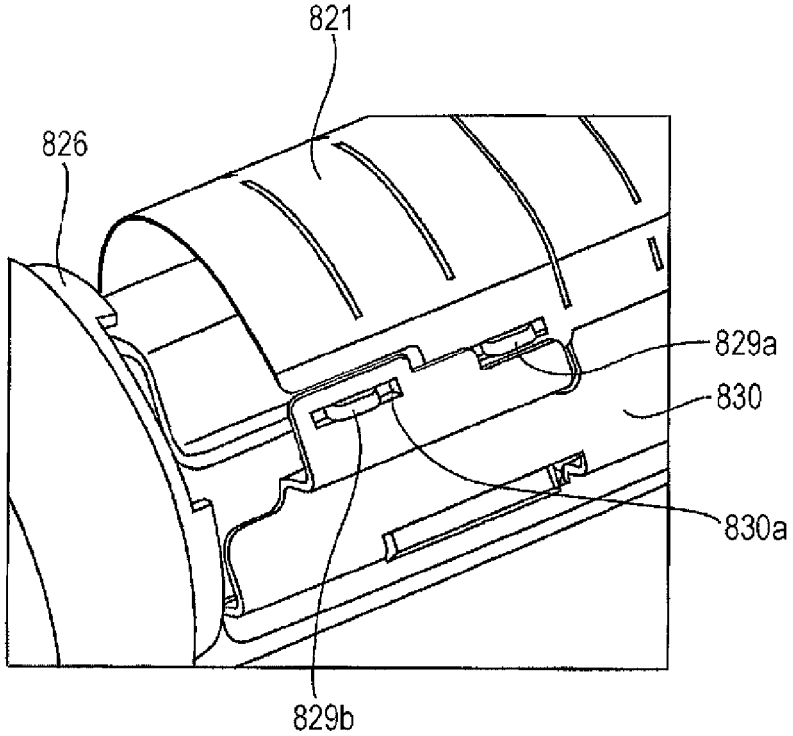
FIG. 12 is an enlarged perspective view showing part of FIG. 11 in a further enlarged form.

FIG. 12 is an enlarged perspective showing part of FIG. 11 in a further enlarged form.

The temperature-sensitive magnetic member 821 is supported by the shielding member 829 shown in FIGS. 4 and 5 when the lugs 829*a* of the shielding member 829 enter the holes 821*b* of the temperature-sensitive magnetic member 821 (see FIGS. 6 to 8). Here, the lugs 829*b* used for supporting the shielding member 829 by the backing member holder 830 are provided on both end portions of the shielding member 829.

With the shielding member 829 supporting the temperature-sensitive magnetic member 821 as shown in FIGS. 6 to 8, the shielding member 829 is supported by the backing member holder 830 when the lugs 829*b* on both the end portions of the shielding member 829 enter the holes 830*a* in both end portions of the backing member holder 830. The backing member holder 830 is formed into a shape that restricts interference of the backing member holder 830 with the lugs 829*a* of the shielding member 829 for supporting the temperature-sensitive magnetic member 821.

Figure 13:
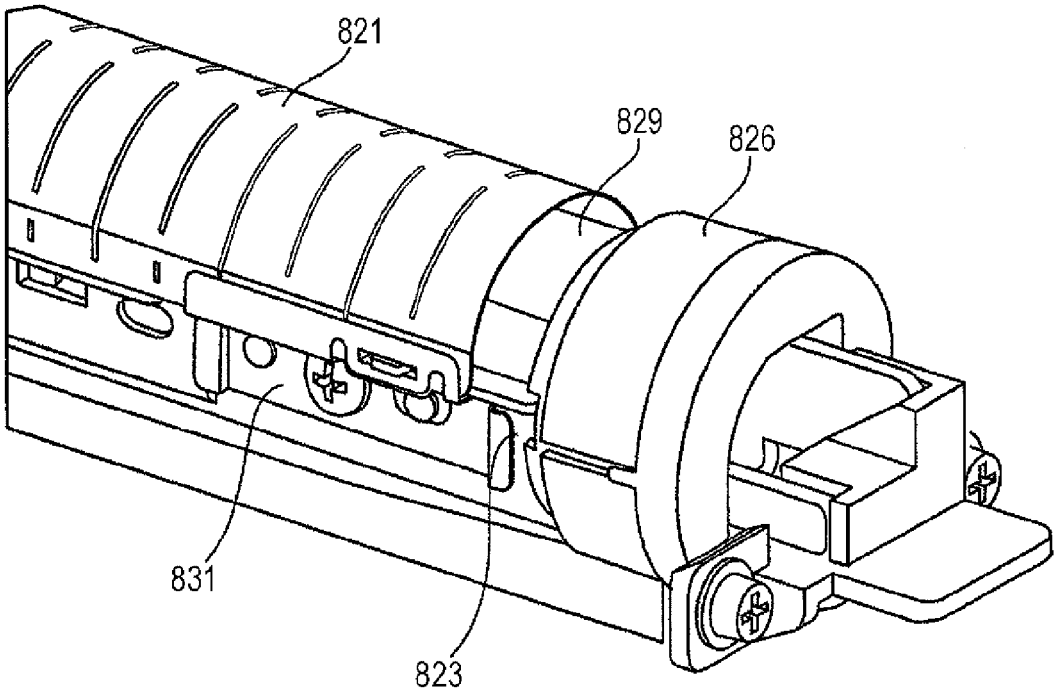
FIG. 13 is a partial enlarged perspective view of a side of the structural member in which the temperature-sensitive magnetic member is mounted on the shielding member, the side being opposite to the side shown in FIGS. 11 and 12.

FIG. 13 is a partial enlarged perspective view of a side of the structural member in which the temperature-sensitive magnetic member 821 is mounted on the shielding member 829, the side being opposite to the side shown in FIGS. 11 and 12.

The backing member holder 830 does not exist on this side. Therefore, the structural member in which the temperature-sensitive magnetic member 821 is mounted on the shielding member 829 is supported by the supporting member 823 by interposing the structural member between supporting plates 831 (provided on longitudinal-direction end portions) and screwing the supporting plates 831 to the supporting member 823.

As described above, the structural member in which the temperature-sensitive magnetic member 821 is mounted on the shielding member 829 is supported only at both end portions via the backing member holder 830 at the side of the backing member holder 830 and by holding the structural member by the supporting plates 831 at the opposite side. That is, the structural member is separated from the supporting member 823 at its central portion excluding both its end portions.

Figure 14A:
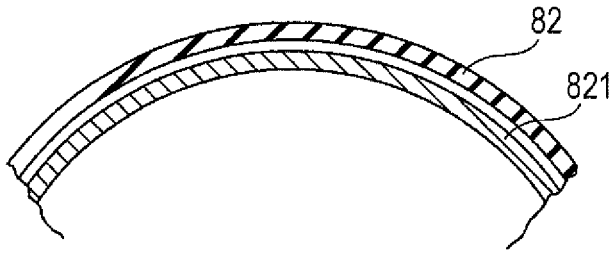
FIGS. 14A and 14B are explanatory views illustrating the advantages that are obtained when the structural member in which the temperature-sensitive magnetic member is mounted on the shielding member is supported only at both end portions thereof by the supporting member.

FIGS. 14A and 14E are explanatory views illustrating the advantages that are obtained when the structural member in which the temperature-sensitive magnetic member 821 is mounted on the shielding member 829 is supported only at both the end portions by the supporting member.

FIG. 14A shows a case in which the structural member is supported only at both the end portions by the supporting member 823, the case corresponding to an exemplary embodiment of the present invention.

Figure 14B:
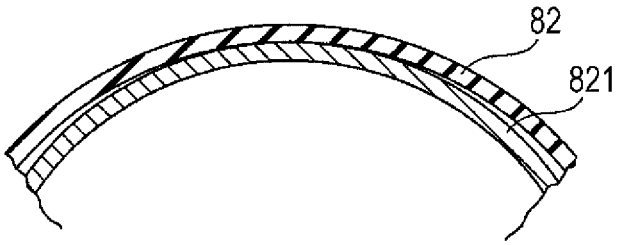

FIG. 14B shows a case in which an entire region of the structural member in the longitudinal direction (width direction of the heating belt 82 (see FIG. 1)) is secured to the supporting member 823, the case corresponding to a comparative example of the present invention.

FIGS. 14A and 14B are both sectional views of a width-direction central portion of the heating belt 82, and both show a portion of the heating belt 82 and a portion of the temperature-sensitive magnetic member 821 towards the IH heater 81 (see FIG. 1).

As described above, the pressure roller 83 (see FIG. 2) is pushed against the heating belt 82. This causes the backing member 822, disposed at the inner side of the heating belt 82, to be pushed, and the supporting member 823, which supports the back side of the backing member 822, to be pushed. As described with reference to FIG. 3, both the end portions 823*a* of the supporting member 823 are supported by the housing 85 of the fixing unit 80 in a doubly supported beam structure. Therefore, when the supporting member 823 receives a pushing force of the pressure roller 83 via the backing member 822, a central portion of the heating belt 82 in the width direction (that is, a direction perpendicular to the plane of FIG. 1 or in a left-right direction in FIG. 3) flexes towards the IH heater 81 in the shape of an arc.

Here, in the exemplary embodiment, the temperature-sensitive magnetic member 821 is supported by the supporting member only at both end portions thereof, and both end portions of the supporting member 823 are supported by the housing 85 of the fixing unit 80. Therefore, it is unlikely for the temperature-sensitive magnetic member 821 to be influenced by the flexing of the supporting member 823. In the exemplary embodiment, the temperature-sensitive magnetic member 821 is disposed apart from the inner surface of the heating belt 82. Therefore, even if the pressure roller 83 is pushed against the heating belt 82, the temperature-sensitive magnetic member 821 is kept apart from the inner surface of the heating belt 82 (see FIG. 14A).

In contrast, if an entire length of the temperature-sensitive magnetic member 821 in the longitudinal direction (that is, the width direction of the heating belt 82) is secured to the supporting member 823, when the pressure roller 83 is pushed against the heating belt 82 and, therefore, the supporting member 823 is flexed, the temperature-sensitive magnetic member 821 also flexes along with the supporting member 823. Therefore, as shown in FIG. 14B, part of the temperature-sensitive magnetic member 821 may contact the inner surface of the heating belt 82. If such a contact occurs, heat of a portion of the heating belt 82 that contacts the temperature-sensitive magnetic member 821 is lost, as a result of which temperature is reduced. This may cause improper fixing. In addition, abnormal noise may be generated or paper wrinkles may be produced as a result of an increase in rotational torque of the heating belt 82 due to wear debris that is produced when the surface of the temperature-sensitive magnetic member 821 is worn due to the contact of the temperature-sensitive magnetic member 821 and the heating belt 82 with each other.

In the exemplary embodiment, the influence of the flexing of the supporting member 823 is restricted, to restrict the occurrence of problems such as those described above.

Here, the temperature-sensitive magnetic member 821 is described as being disposed apart from the inner surface of the heating belt 82. However, a fixing device having a structure in which the temperature-sensitive magnetic member 821 is in contact with the inner surface of the heating belt 82 is also proposed. Even in this case, if the entire temperature-sensitive magnetic member 821 in the longitudinal direction thereof is secured to the supporting member 823, pushing force of the pressure roller 83 causes part of the temperature-sensitive magnetic member 821 to strongly contact the inner surface of the heating belt 82. This may result in problems such as those described above. Consequently, the present invention is also applicable to a fixing unit in which the temperature-sensitive magnetic member is in contact with the inner surface of the heating belt.

Although, here, the printer of the type shown in FIG. 1 and the fixing unit of the type shown in FIG. 2 are given as examples, the present invention is not limited to these examples. That is, as long as the image forming apparatus according to exemplary embodiments of the present invention is a type in which a toner image is formed on a sheet and fixed thereto, the image forming apparatus may have any specific structure. Regarding the fixing device, as long as the fixing device uses a heating belt and a pressure roller and includes a temperature-sensitive magnetic member provided at an inner surface of a heating belt, the present invention is applicable.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A fixing device comprising:

a magnetic field generator that generates a magnetic field;

a heating belt that is heated by the magnetic field generated by the magnetic field generator, and that, while circulating, heats toner on a transported sheet holding an unfixed toner image;

a pressure roller that rotates while being pushed against an outer surface of the heating belt and that presses the transported sheet as a result of interposing the sheet between the pressure roller and the heating belt;

a temperature-sensitive magnetic member that is disposed at an inner surface of the heating belt so as to oppose the magnetic field generator with the heating belt being interposed between the temperature-sensitive magnetic member and the magnetic field generator, the temperature-sensitive magnetic member being heated by the magnetic field generated by the magnetic field generator;

a backing member that is disposed at the inner surface of the heating belt so as to oppose the pressure roller with the heating belt being interposed between the backing member and the pressure roller, the backing member defining a movement path of a region of the heating belt that contacts the pressure roller; and a supporting member that (1) is disposed at an inner side of the heating belt, (2) supports both end portions of the heating belt in a width direction defined along a longitudinal direction of the temperature-sensitive magnetic member, (3) supports a back surface of the backing member, and (4) supports the temperature-sensitive magnetic member, the back surface of the backing member being a back surface in relation to a front surface of the backing member that contacts the inner surface of the heating belt; and a shielding member that is separate from the supporting member and disposed with the temperature-sensitive magnetic member being interposed between the inner surface of the heating belt and the shielding member, wherein the only portions of the temperature-sensitive magnetic member that the supporting member supports are both end portions of the temperature-sensitive magnetic member in the width direction so as to avoid ununiform contact of the temperature-sensitive magnetic member with the heating belt caused by flexing of the supporting member due to the pressing by the pressure roller, and wherein the shielding member suports the temperature-sensitive magnetic member at middle position located between the end positions of the temperature-sensitive magnetic member.

2. The fixing device according to claim 1, wherein the shielding member intercepting magnetic force that has leaked out from the temperature-sensitive magnetic member, wherein the supporting member supports both the end portions of the temperature-sensitive magnetic member via the shielding member by supporting both end portions of the shielding member in the width direction.

3. The fixing device according to claim 1, wherein the temperature-sensitive magnetic member is disposed apart from the inner surface of the heating belt and at a position opposing the inner surface of the heating belt.

4. The fixing device according to claim 2, wherein the temperature-sensitive magnetic member is disposed apart from the inner surface of the heating belt and at a position opposing the inner surface of the heating belt.

5. An image forming apparatus comprising:

an image forming unit that forms an unfixed toner image on a sheet and that transports the sheet downstream; and a fixing section that heats and presses toner on the transported sheet holding the unfixed toner image, and that fixes the unfixed toner image to the sheet, wherein the fixing section includes a magnetic field generator that generates a magnetic field;

a heating belt that is heated by the magnetic field generated by the magnetic field generator, and that, while circulating, heats the toner on the transported sheet holding the unfixed toner image;

a pressure roller that rotates while being pushed against an outer surface of the heating belt and that presses the transported sheet as a result of interposing the sheet between the pressure roller and the heating belt;

a temperature-sensitive magnetic member that is disposed at an inner surface of the heating belt so as to oppose the magnetic field generator with the heating belt being interposed between the temperature-sensitive magnetic member and the magnetic field generator, the temperature-sensitive magnetic member being heated by the magnetic field generated by the magnetic field generator;

a backing member that is disposed at the inner surface of the heating belt so as to oppose the pressure roller with the heating belt being interposed between the backing member and the pressure roller, the backing member defining a movement path of a region of the heating belt that contacts the pressure roller; and a supporting member that (1) is disposed at an inner side of the heating belt, (2) supports both end portions of the heating belt in a width direction defined along a longitudinal direction of the temperature-sensitive magnetic member, (3) supports a back surface of the backing member, and (4) supports the temperature-sensitive magnetic member, the back surface of the backing member being a back surface in relation to a front surface of the backing member that contacts the inner surface of the heating belt; and a shielding member that is separate from supporting member and disposed with the temperature-sensitive magnetic member interposed between the inner surface of the heating belt and the shielding member, wherein the only portions of the temperature-sensitive magnetic member that the supporting member supports are both end portions of the temperature-sensitive magnetic member in the width direction so as to avoid ununiform contact of the temperature-sensitive magnetic member with the heating belt caused by flexing of the supporting member due to the pressing by the pressure roller, and wherein the shielding member supports the temperature-sensitive magnetic member at middle position located between the end positions of the temperature-sensitive magnetic member.

* * * * *